United States Patent [19]

Gibbar, Jr.

[11] Patent Number: 5,038,541

[45] Date of Patent: Aug. 13, 1991

[54] POLYMER BUILDING WALL FORM CONSTRUCTION

[76] Inventor: James H. Gibbar, Jr., 1100 Lottes St., Perryville, Mo. 63375

[21] Appl. No.: 522,327

[22] Filed: May 11, 1990

Related U.S. Application Data

[63] Continuation-in-part of Ser. No. 176,650, Apr. 4, 1988.

[51] Int. Cl.[5] ..... E04B 2/28; E04B 2/44; E04C 2/26

[52] U.S. Cl. ..... 52/295; 52/309.12; 52/426; 52/442

[58] Field of Search ..... 52/309.7, 309.12, 204, 52/426, 442, 405, 295, 612, 562

[56] References Cited

U.S. PATENT DOCUMENTS

| | | | |
|---|---|---|---|
| 4,234,634 | 11/1980 | Longinotti | 52/309.12 |
| 4,516,372 | 5/1985 | Grutsch | 52/309.12 |
| 4,604,843 | 8/1986 | Ott | 52/309.12 |

*Primary Examiner*—John E. Murtagh
*Attorney, Agent, or Firm*—Paul M. Denk

[57] ABSTRACT

A polymer building or other structured wall form construction wherein forms prefabricated of polymer, such as polystyrene, are assembled together, spaced apart by integrally connecting polymer or blocks, spacers, or spool means, erected upon a foundation footing, or other base structure, through their insertion of L-shaped ties, with the wall forms being erected to the height desired for the subject building or other structure, whether it be a commercial, industrial, or residential building, through the application of tee-shaped ties therebetween, Reinforcement is located in the spacing between the blocks or spacers, of the wall forms, and concrete may be poured therein, either at the job site, where the building is being constructed, or at the manufacturing plant, where the wall forms are formed, in order to provide a latticework of reinforced concrete for the composite wall. The internal surface of each of the inner and outer liners forming the wall form are shaped, into the configuration of an I-beam, in order that any concrete poured therein will undertake the cross-sectional configuration of an I-beam, to add further reinforcement to the fabricated building, once a wall is completed. A top beam form of plate cap is arranged upon the upper edge of the formed wall, with the concrete being poured simultaneously with the construction of the assembled wall. Bracing held together by ties and locked into position by fasteners secure the wall forms together, in their erected disposition, in preparation for the pouring of the latticework of concrete reinforced composite wall.

14 Claims, 8 Drawing Sheets

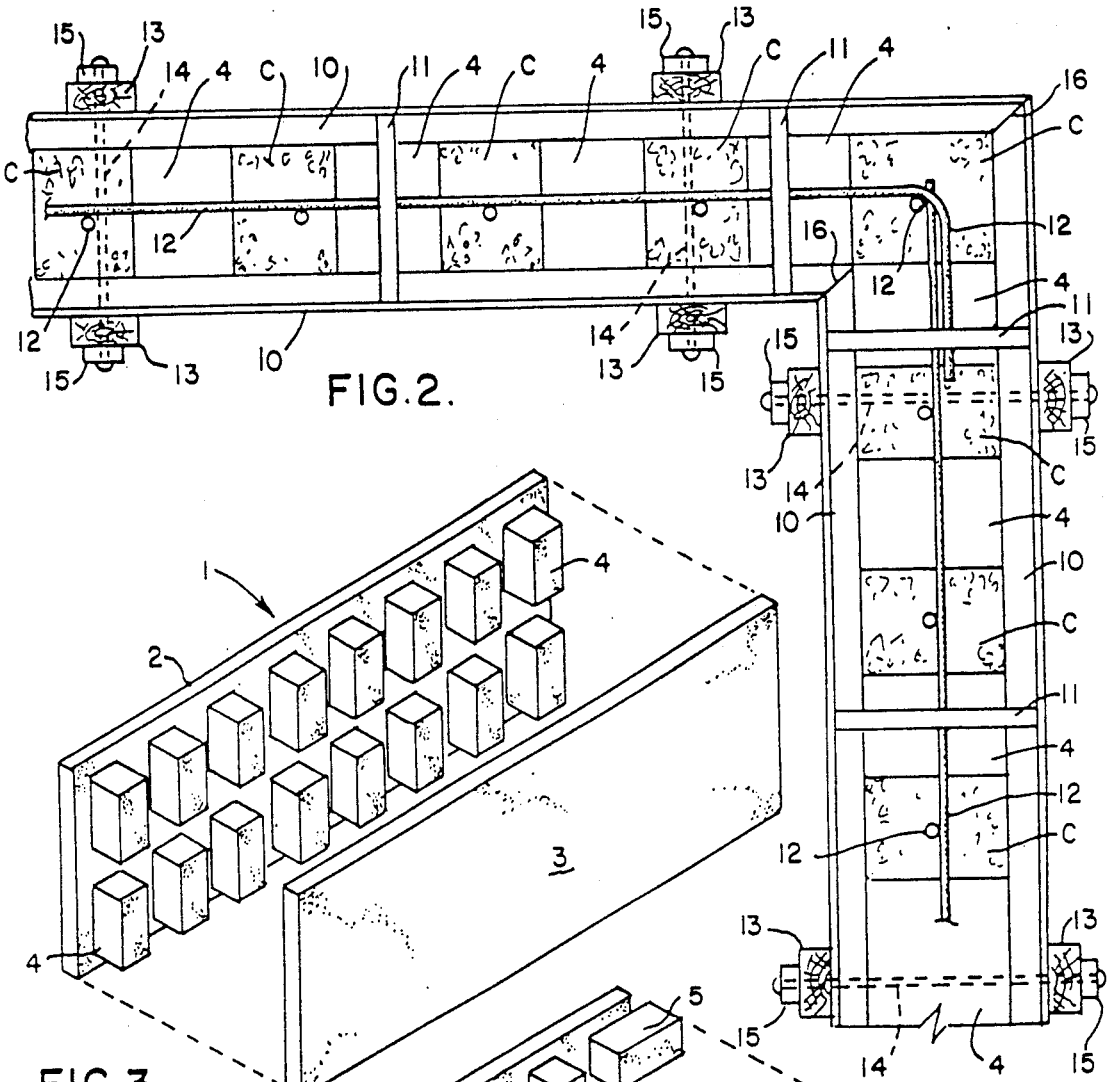
FIG.2.
FIG.3.
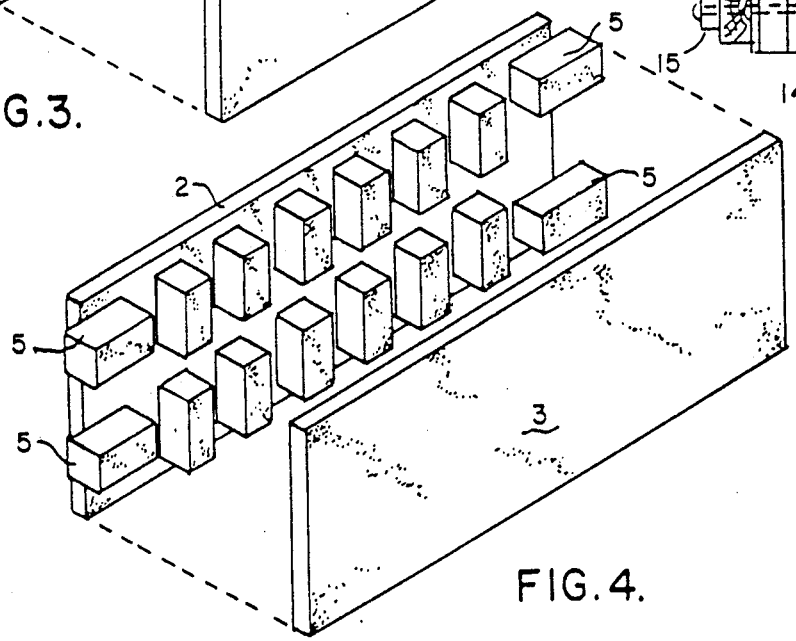
FIG.4.

POLYMER BUILDING WALL FORM CONSTRUCTION

CROSS-REFERENCE TO RELATED APPLICATION

The subject matter of this application is related to and comprises a continuation-in-part of the patent application to the same inventor filed on April 4, 1988, having a Ser. No. 07/176,650.

BACKGROUND OF THE INVENTION

This invention relates generally to a composite wall fabricated of a combination of polymer forms, providing a latticework of voids therein, and into which concrete can be poured, to provide a monolithic wall structure that is fully supportive of the building, its roof, and yet of significantly reduced cost due to the uniqueness of its fabrication.

A large number of wall structures, designed to ease and reduce the expense of fabrication of building walls, foundation walls, or the like, have long been available in the art. For example, the United States to O'Beirne, discloses an interlocking concrete panel. As can be seen therein, the various blocks apparently are designed to be interfitted together, within its panel structure, but obviously, since polymers and plastics were not available at the time, such blocks and panels were fabricated of other materials. It provides spacing within the blocks where concrete could be filled therein, during the formation of its intended wall. The panels that form the wall constitute the completed wall's inner and outer faces, as can be seen in said patent, but the particular materials from which these panels were fabricated do not appear to be explained in the identified patent. Nevertheless, the patent does disclose flange means that tie the panels together, interfitting within key-like grooves, meaning that apparently the panels are left in place, once the concrete is poured intermediate the inner and outer faces of the wall formed by the shown panels.

The U.S. Pat. No. 2,181,698, to Langenberg, discloses another form of wall construction. In the particular design as disclosed, it appears that the wall, once again, is formed of various inner and outer slabs, which are interlocked together by means of connecting ties. It is shown that the slabs themselves are constructed of concrete, as can be noted in their cross section within the identified patent. Concrete is then poured between the slabs during the formation of the disclosed wall.

The U.S. Pat. No. 3,149,437, to Wheeler-Nicholson, discloses another form of building construction. The forms used therein are quite complex, of fabrication, but do include various interior panels between inner and outer panels, and which function for a modular fitting for connecting of the next adjacent wall panels together. Concrete is then poured therein, and the building fabricated from the type of wall that can be constructed to include window apertures, that are fabrication during the formation of the constructed wall.

The U.S. Pat. No. 3,220,151, to Goldman, shows a building unit with laterally related interfitting panel sections. This patent shows that the panels may be molded of any cementitious material, or may be fabricated of any suitable plastic material, in their construction. The panels include a series of integrally formed lugs, which apparently interfit together, when the panels are located into position, as shown. Concrete is then poured therein, to provide for the desired wall structure, and it would appear that lugs are integrally formed upon their various panel interior surfaces, and that the panels do remain in place after a foundation has been poured. It would also appear that reinforcing rods might fit through various apertures provided in the panels, for reinforcement purposes. In addition, the patent does explain that various voids may be provided for furnishing of window and door apertures.

The U.S. Pat. No. 3,552,076, to Gregori, discloses another type of concrete form. As can be noted, the various units may be fabricated of a polymer, such as polystyrene, and which are placed in layers to provide and accommodate the pouring of concrete therein. And, since there are a variety of partition walls that are integrally structured into the units, these particular units are designed for permanent installation, and provide insulation for the building in which they are arranged. Each of the partitions further appear to include recesses for holding horizontally emplaced steel reinforcing rods, in preparation for pouring of the concrete internally of the various units.

The U.S. Pat. No. 3,584,826, to Liester, discloses another form of concrete wall forming apparatus and method. This particular device includes a series of half forms, as can be noted, which are located and placed adjacent each other, and thereby provide circular spacings intermediate the forms wherein concrete is poured. This particular structure, although formed of a series of these formed members, in their configuration, are similar to the construction and structure of panels that are generally marketed in the trade under the trademark Luxit, by a Swiss company of the same name, which utilizes polystyrene wall panels, emplaced together, and having a series of horizontal and vertical cavities therein, and into which concrete is poured in the formation of a wall. Another patent identified belonging to the said Swiss company is U.S. Pat. No. 4,439,122.

Another U.S. Pat. No. 3,689,021, to Liester, discloses another type of apparatus for concrete wall construction. It utilizes forms incorporating various open cells constructed into the shape of the forms that apparently are made of polyurethane. But, it also appears that the object of these type of formed walls is to provide a see-through form type of concrete wall construction, meaning that the forms are apparently removed once the wall is constructed. It also appears that the particular designed wall is more for ornamental wall or fence purposes, rather than as a building wall construction.

The U.S. Pat. No. 3,788,020, to Gregori, discloses a foamed plastic concrete type of form with fire resistant tension members. As can be noted therein, the particular develop form functions as a concrete form, made of foamed polymeric material, and which is left in place to function as insulation, for the wall, when constructed after concrete has been poured within its internal cavities.

The U.S. Pat. No. 3,908,326, to Francis, shows a development entitled "A Brick Panel Construction". The development appears to be more of a surface type brick panel that provides a facade over a concrete or other poured wall. It does show extensions at the end of the panel, apparently for overlapping each other, when assembled into position.

The U.S. Pat. No. 4,229,920, to Lount, shows another type of foamed plastic concrete form and connectors therefor. These panels are made of foamed plastic, and include their specific style of anchor members therebetween, so that a pair of the panels are held in spaced position when concrete is poured within them.

The U.S. Pat. No. 4,426,061, to Taggart, shows another form of method and apparatus for forming insulated walls. The development discloses the use of adjacent sheets of insulating material, held in position by means of tie holders, that are structured for supporting cross members, such as the beams as disclosed. Various apertures in the form of windows and doors can also be constructed into the structure, through the usage of the shown development.

The U.S. Pat. No. 4,439,967, to Dielenberg, discloses an apparatus relating to building form work. This particular device, as shown, is formed of a series of interlocking blocks, held together by various corner and tee connections, and which are formed of hard foam resin material that has high insulating properties. Within the blocks are provided spacings in which concrete is poured.

The U.S. Pat. No. 4,577,447, to Doran, shows a construction block, formed as building block, and apparently constructed of polystyrene beads. The blocks, as shown, have a series of upstanding members formed upon the surface of each half member, with each having either a protubrance, or a recess, so that the half members can be interfitted together during fabrication.

The U.S. Pat. No. 4,578,915, to Schneller, shows another form of exterior wall. It describes a method for forming an exterior wall of a building, constructed of high density rigid sheathing board, affixed to vertical studs, and having a wall structure of laminated concrete-stucco provided thereon.

The U.S. Pat. No. 4,706,429, to Young, discloses a permanent non-removable insulating type concrete wall forming structure. The wall as shown therein is likewise formed of a modular synthetic plastic, for providing a concrete formed structure, held apart by means of particular types of attachment means, in the form of plastic ties, and into which concrete can be poured. One can also note that the side and upper surfaces of the shown panels are designed for mating with the next adjacent panels.

Finally, various publications have defined the construction of foam homes, which are generally panels prefabricated of foam material, and which are interfitted together into some type of geodesic shape for furnishing a building structure.

It is, therefore, the principal object of the current invention to provide a prefabricated type of wall, that combines the usage of a wall form, formed of a pair of sheet-like material, preferably constructed of polystyrene, with one of the sheets incorporating integrally prepositioned blocks or spacing elements, so that the wall can be immediately assembled through the interconnecting of a variety of these wall forms together, braced into position, supported in alignment by means of a variety of ties, which are strapped together to assure a precise thickness for the completed wall, for receiving the deposition of concrete therein, to provide a monolithic wall which is both structurally reinforced through a combination of concrete latticework, formed within the polymer wall forms, all of which add significant insulative value to the reinforced wall during any building's occupancy.

Another object of this current invention is to provide a series of wall forms, of significant size, which can be interconnected together into both lateral adjacency, and vertically stacked, being braced by means of bracing means, to provide a unique formed wall in preparation for deposition and reception of a reduced amount of concrete therein, and of significant size to accommodate the development and construction of a building of either small or large capacity.

Another object of this invention is to provide a series of wall forms that can be constructed into the fabrication of a concrete wall, and greatly enhance its insulative value during usage.

Still another object of this invention is the provision of a variety of unique accessories for use in conjunction with a polymer wall form, for use for constructing a monolithic concrete-polymer wall, and which accessories provide for the convenient emplacement of the various wall forms into position, their assembling together, when fabricated into an overall form in preparation for the pouring of the concrete therein during building wall construction.

Another object of this current invention is to provide a one-piece polystyrene wall panel, for use as a form, for constructing of a load bearing wall, when concrete has been poured therein, and which wall can be constructed to continuous lengths, or even heights, depending upon the size of building specified and required.

Another object of this invention is to provide the fabrication of a building wall, formed of a composite of concrete and polymer wall forms, which significantly reduces building costs, and its erection time, thereby providing efficiency in the labor costs entailed.

Still another object of this invention is to provide a permanent and insulated reinforced concrete wall constructed of polymer panels and wall forms.

Still another object of this invention is to provide a wall form, constructed preferably of polystyrene polymer material, which has high insulative value to it, thereby allowing for the pouring of the concrete latticework therein even when subjected to temperature extremes.

Still another object of this invention is to provide a wall form, which when combined together for formation of an overall wall structure, requires a minimum of reusable bracing for interlocking the same together during wall construction.

Another object of this invention is to provide a wall form that may be combined into a composite concrete wall structure, and which has by design a thermal resistant value of at least R35.

Still another object of this invention is to provide a composite wall formed of concrete and polymer and which requires no special tools or equipment in its installation, assembly, and construction.

Yet another object of this invention is to provide a composite wall which may have designed into it any size or positioned openings and into which may be located prefabricated doors or windows as required by necessity or code.

A further object of this invention is to provide a monolithic concrete and polymer wall having high insulative value, as previously explained, thereby reducing utility and insurance costs.

Still another object of this invention is to provide wall forms, preferably constructed of polymer, such as polystyrene material, and which may have added to it various flame-retardant materials, to add to its factor of safety.

Still another object of this invention is to provide a monolithic wall of concrete and polymer, which has high shear strength, wind resistance, and also incorporates reinforcement structure that may be earthquake resistant.

Yet another object of this invention is to provide a combined polymer and concrete wall that may function as a foundation wall for a building.

Another object of this invention is to provide a process setting forth a procedure for creating a monolithic concrete wall incorporating polymer forms.

A further object of this invention is to provide a combined polymer and concrete wall that is fabricated into the configuration of what is identified as the I-core construction, forming within the polymer wall forms, a concrete reinforcement system that is generally configured in the shape of an I-beam.

Still another object of this invention is to provide a monolithic wall of concrete and polymer which is constructed to a particular configuration, in panels that may be prefabricated at the manufacturing plant, and then transported to the site of construction, where the panels may be independently handled by the contractor and assembled into the formation of a wall of the designed building under construction.

Still another object of this invention is to provide a composite wall fabricated of polymer panels and wall forms, formed of a pair of sheet-like material, preferably constructed of polystyrene, and which are spaced apart into the formation of the wall form by means of spacer spools.

Still another object of this invention is to provide a wall form incorporating a pair of sheets of panels, spaced apart by means of spools that are also fabricated of polystyrene or other polymer material.

Yet another object of this invention is to provide a wall form that is substantially strong in construction, lightweight to handle within the manufacturing plant, for use for prefabricating of building walls that may be transported to the job site for usage.

These and other objects may become more apparent to those skilled in the art upon reviewing the summary of this invention, and upon undertaking a study of the description of its preferred embodiment in view of the drawings.

SUMMARY OF THE INVENTION

This invention contemplates the formation of wall forms, preferably constructed of a polymer, and more specifically of a polymer such as foam urethane, but preferably polystyrene, and which wall forms are fabricated of a pair of sheet material, which in the preferred embodiment, is generally constructed in sheets measuring four feet by eight feet in dimension, or larger. One of these sheets incorporates, integrally, during its formation, a series of blocks or spacers formed therein, and which extend that distance away from the interior surface of its sheet, to provide the thickness for the concrete wall to be poured therein, to that dimension which is compatible with code requirements, and which will assure the strength required for the designed reinforced concrete and composite wall of this invention. Again, in the preferred embodiment, these blocks or spacers are generally of a dimension of six inches by twelve inches in cross section, and have a width of approximately eight inches, so that any concrete that is poured within the formed wall, once erected, will provide a latticework of concrete reinforcement therein, having a thickness of at least eight inches in dimension. Obviously, other thicknesses may be specified.

In the construction of the wall form of this invention, and in the desired configuration, the pairs of sheet material that are brought together to form the wall, and its form, are provided for furnishing a permanent interior panel, and a similar exterior panel, for the intended wall construction. The interior panel, since it will be exposed to lesser than rigorous conditions within the interior of any building to be formed through this construction, may be made of less dense material, and therefore, in the preferred embodiment, where polystyrene is utilized in the construction of the interior sheets, a one pound density polystyrene material is useful and has been found adequate, for the fabrication of this particular component of the wall. The exterior panel, on the other hand, which is subjected to the rigors or exterior exposure, may be formed of a more denser polystyrene, which, in the preferred construction, may be fabricated of two pound, more or less, density polystyrene beads. In addition, in the formation of the polystyrene panels, and even its spacers, or in the formation of the styrene beads themselves, it may be desirable to include various other ingredients, such as flame-retardant chemicals, processed integrally within the polystyrene materials, in order to add to the inflammable characteristics of any wall and building constructed in accordance with the forms of this invention. Such flame-retardant materials are readily available in the art, and may include such chemical modifying agents such as the various phosphorous compounds, and other related chemicals, useful for this purpose. (These additives may also include gypsum, chlorine or bromine derivatives, and polycarbonates, as examples.) In addition, other additives may include a fungicide, and a bacteriacide, useful for resistant to fungus growth or insect infestation, particularly in the polymer components of this composite wall, in order to assure its more enduring life.

Inherent in the subject matter of this development are the methods and means by which the various wall forms are integrated together, in the formation of an overall wall structure, and wherein, obviously, while the forms of the preferred embodiment of this invention may be of approximately four feet by eight feet in dimension, a building wall may be of substantially greater size. Hence, a plurality of these wall forms will need be interconnected together, to form the overall dimension for the building wall, and various ties are generally incorporated at either the bottom of the entire wall structure, when initially assembled, and between the other horizontally disposed upper and lower edges of vertically adjacent forms, when a higher wall is designed, to assure their positioning and alignment for functioning as a structurally sound wall form, in preparation for pouring of concrete therein. The ties provided at the bottom of the wall forms are generally of L-shape, are designed for resting directly upon the foundation footing, and stradle substantially equidistant from any reinforcing rods that may have been previously embedded within the footing, during its pouring, and which extend upwardly for tying into the eventual concrete poured foundation wall. In addition, a series of straps of designed length link between each pair of L-shaped tees, at various predetermined spacings apart, and have a distance between their upright flanges equivalent or just slightly greater than the overall dimension of the polymer wall form, so that the wall form can easily slide and be inserted within the L-shaped ties, when assembling the forms for the construction of the desired wall.

Between vertically disposed adjacent wall forms, upwardly from the bottom, and where they are mounted one upon the other to provide height for the contemplated wall, the ties are in the shape of a tee, spaced apart the same distance as the L-shaped ties, by means of a series of arranged straps, so that a pair of aligned tees can be easily inserted onto the upper edge of a wall form, that is, upon the upper edge of each of the sheets of each subjacent wall form, and have the next upwardly adjacent wall forms easily inserted thereon, when erecting the wall form for the intended wall. Thus, as can be readily observed, the wall forms can be easily assembled, one upon the other, in order to add vertical height to the structured wall, and in addition, can be aligned laterally with respect to each other, being held into position by means of the emplaced L-shaped ties and tee-shaped ties, to provide a reasonably stable wall, formed of the polystyrene forms of this invention, all in preparation for the deposit or pouring of wet and flowable concrete therein, in fabrication of the overall composite wall structure.

Obviously, before any concrete is poured into the structure, and as the wall forms are being erected, variously arranged reinforcement, such as reinforcing rods, will be inserted therein, generally arranged through the wall forms, provided normally equidistant or centrally between the sheets of the wall forms, and tied into position, either upon the upstanding reinforcing rods extending from the footing, or connecting onto the various tie straps, as previously explained, to achieve their positioning, and to assure that they remain aligned in position, when concrete is being poured therein. In addition, reinforcement, such as reinforcing rods, will likewise be bent around the corners of any formed wall, within the wall forms, during their assembly.

The corner of an intended wall structure can be easily fabricated to that particular angle, such as a ninety degree turn, customarily built into the corner of a building. This can be done with the current invention, simply by cutting the wall forms to a designated bevel, generally at forty-five degree angle, so that the ends of the bevelled wall forms will compatibly mate together, to form a right or other angled wall, or to what other angle has been designed into the building structure, for assuring a completed wall around the perimeter of the building through the usage of this particular invention.

In addition, and before any high density concrete is poured into the arranged forms, it is desirable to brace the structured wall forms into position, and generally at their end seams, where they meet in adjacency with the next aligned forms, and upright bracing, in the design of a two by fours, will be located into position, a tie means extended through the wall forms, and located through an aperture provided aligned within each of the interior and exterior located bracing, and then held into position by means of a removable fastener, which structurally secure the wall forms together into the structured wall, in preparation for pouring of concrete, but which can be readily removed, by removing of the fasteners, and displacing of the bracing, once the poured concrete has been deposited, and hardened, within the composite wall structure. Thus, as can be readily determined, very little is wasted in the fabrication of a wall from the prefabricated polymer wall forms of this invention, during application.

It is further likely that other components need to be built into the wall structure, to comply with architectural designs, such as the fabrication of door and windows within the wall structure, or even the provision of a top beam plate cap, one which is adequately reinforced, for supporting of roof or ceiling girders thereon, during building construction. This can be achieved by providing forms upon the upper edge of the intended top of the wall forms, or the upper edge of the intended building wall, as constructed, and then have poured therein additional concrete, fully reinforced by rods, at this upper segment, to provide the style of top beam necessary to adequately support a plurality of roof girders, and the heavy weight of a roof, during building assembly. In addition, various header boards, jambs, sills, and the like, can be framed into the wall structure, cut through the wall forms during their assembly, to provide apertures within the structured wall, even after concrete is poured, and into which prefabricated doors or window sets can be readily installed, during building fabrication It is also likely, and within the contemplation of this invention, that the polystyrene or other polymer forming the sheets of the wall forms of this development can be further treated, and either coated with a gypsum, a polyvinyl resin, or any other type material, that may be useful for providing a finished surface onto the used sheets, such as to form the interior wall of the building, as for its intended purpose. For example, a polyvinyl spray may be applied or laminated onto a certain segment of the interior sheet of the wall forms, in order to withstand refrigerated temperatures where the building may be used for low temperature operations. In addition, gypsum or wall board may be applied to the various ties, once emplaced, by means of any standard dry wall application means, or other clips, in order to provide a finished interior wall for the building. Likewise, the exterior of the building may have coated upon it any type of cementitious material, such as stucco, or have a grid work of netting or wire or other related type of material to which stucco may be readily applied, in order to afford a finished exterior surface to the building. In addition, it is likely that the usual thermal or moisture barrier may be applied to the exterior sheet of the wall forms, once the wall has been formed into a composite concrete structure, and have masonry applied in adjacency therewith.

It should be readily observable from reviewing this invention, its drawings, and from the description of its preferred embodiment, that the subject matter of this invention is to provide a series of wall forms, constructed of a pair of inner and outer sheets, having spacers therebetween, integrally formed extending from one of the sheets, and which provides a latticework of voids within each wall form, and which are in communication with the voids contained within the horizontally and vertically adjacent wall forms, all of which form a latticework of voids into which concrete may be poured in the construction of the monolithic and reinforced wall of this invention. The type of concrete used in the fabrication of the wall, in the preferred embodiment, has been found to be a mix of six bags of cement per yard of the desired concrete. Furthermore, in order to assure that the concrete has fluidity to it, and will flow into all of the various voids contained within the erected wall forms, other additives may be blended in with the wet concrete, such as a material entitled "Sarabond", obtainable from Dow Chemical Company, of Midland, Mich., and which adds to the fluid flow of concrete, when applied for the purposes of this invention. Although, the inventor has found that such an additive is really not needed to achieve the desired results of his development.

The concept of this invention further envisions the prefabrication of building walls, at a manufacturing plant, where the series of wall forms, constructed of a pair of inner and outer sheets, may be spaced apart through the usage and application of spacer means, such as polymer or other material formed spools, which provide the adequate and precise spacing of the pair of forms apart, so that the type of cementitious material as previously described may be poured therein, for forming a segment of an intended building wall. More specifically, the invention further envisions the preshaping of the inner surface of the pair of wall forms, or their inner and outer sheets thereof, such that when a concrete or other cementitious material is poured within the form, it undertakes a cross-sectional configuration equivalent to the shape of an I-beam, being reinforced with proper reinforcing materials, in order to add to the enhancement of the strength of any wall fabricated from a series of the wall forms of this invention. After the wall segments are fabricated at the plant, they can then be transported to the job site, and conveniently located by means of a series of previously spaced I-beam or other cooperating structure, that has previously been vertically erected, so that the walls cf the building can be readily assembled into position, slid into emplacement between a pair of precisely spaced vertical beam structures, for use for supporting the wall into its final disposition once assembled.

Furthermore, the spacer means used within the wall forms of this invention, and to space the series of inner and outer sheets of each wall form apart, may include the usage of the identified spools, conveniently placed at particular locations spacely along the length of the sheets forming the wall form, so as to provide convenient voids within the concrete once poured, but yet, not detract from its structural strength, particularly since the spools are located at those locations where the web of the concrete beam is formed, and not within its strengthened upper and lower flange areas.

BRIEF DESCRIPTION OF THE DRAWINGS

In referring to the drawings.

FIG. 2 is a top plan view thereof, but also showing bracing utilized to support the wall forms during their initial erection, and before and during the pouring of any concrete therein;

FIG. 3 is an exploded view of one of the wall forms of this invention, showing its two sheets, and the integral blocks or spacers extending from the interior of one of said sheets;

FIG. 4 is an exploded isometric view of a slightly modified wall form of this invention, as shown in FIG. 3, but wherein a number of the blocks or spacers at the lateral edges of the form are extended, in order to straddle within the next laterally adjacent wall forms for purposes of stabilization;

DESCRIPTION OF THE PREFERRED EMBODIMENT

Figure 1:
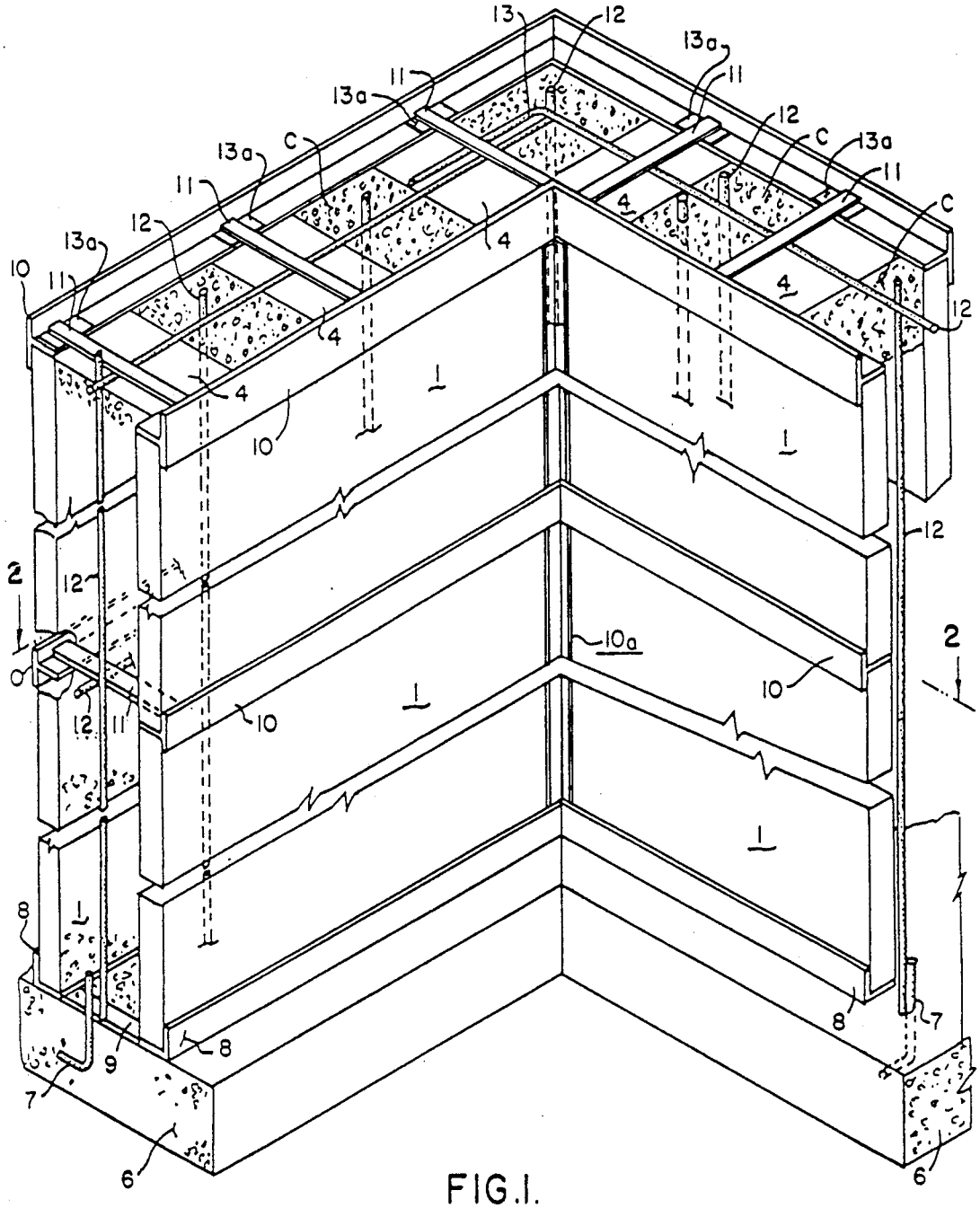
FIG. 1 is an isometric view of the wall forms, at a building corner, containing a supply of poured concrete therein, in the fabrication of a composite wall under development utilizing the principle of this invention.

In referring to the drawings, and in particular FIG. 3, the basic configuration for the wall forms 1 of this invention are disclosed, and as can be seen, and as previously summarized, includes a pair of sheets, 2 and 3 of polymer material, such as polystyrene, and which may have a thickness to that extent which adds sufficient rigidity to the form, when placed into workable condition, for holding a supply of concrete as poured therein. In a preferred embodiment, the thickness of said sheets may be in the vicinity of one to three inches, with approximately a two inch thick sheet having been found to be adequate. One of the sheets, and usually the exterior sheet, has integrally formed thereon, also of polystyrene, a series of blocks or spacer means, as at 4, and which are designed to provide for the necessary spacing between the form sheets, and which eventually provides the thickness of the concrete latticework poured therein, during formation of a wall. Normally, in the preferred embodiment, the sheets will have the thickness as previously explained, and have a rectangular dimension of approximately four feet by eight feet. Although, for obvious reasons, these dimensions may vary. In addition, the blocks may have a dimension of approximately six inches by twelve inches, and have an eight inch thickness to provide for that spacing between the sheets 2 and 3, for reasons as previously explained. The dimensions between blocks are also approximately six inches, in order to provide adequate clearance and a latticework of voids into which the concrete will easily flow, when pouring the reinforced concrete wall of this development. The blocks are also spaced approximately three inches from the sheet edges, in order to complimentary be dimensioned approximately six inches from the next adjacent blocks of the adjacent wall forms, when located into their operative and installation positions. The sheet with integral blocks may then be glued or otherwise adhered to the other sheet to form a complete wall form unit.

As can be seen in FIG. 4, the end blocks 5 of the sheets 2 and 3 extend some distance externally of the edges of the shown polystyrene sheets, and thereby may extend into the next laterally adjacent wall forms, in order to provide stability between laterally positioned forms, during their installation and assembly.

As can be seen in FIG. 1, a variety of the wall forms 1 are disposed for vertical installation, one upon the other, as for example, when a building having an approximate eight foot height is required, two such of the forms may be installed, one upon the other, to provide a wall of this height. A footing 6 will have been previously excavated and poured into position, as noted, and various reinforcing rods, or rebars, as shown at 7, will have been previously installed, and located at that position where they will be centrally arranged within any fabricated wall constructed in accordance with the teachings of this invention. In addition, in order to conveniently align the wall forms upon the footing 6, a series of L-shaped ties, as at 8, will be positioned upon the footing, and a series of straps, one as shown at 9, are fixed to each of the shaped ties 8, at predetermined distances apart, in order to provide that convenient width dimension between the ties and into which the lowermost wall forms 1 may insert, during their installation before the pouring of any concrete wall therein. Obviously, these shaped ties 8 may extend for significant distances, preferably being of greater length than the wall forms 1, so as to span the abutting edges between adjacent wall forms, and add to their convenient and aligned installation within the prefabricated wall form structure.

Figure 8:
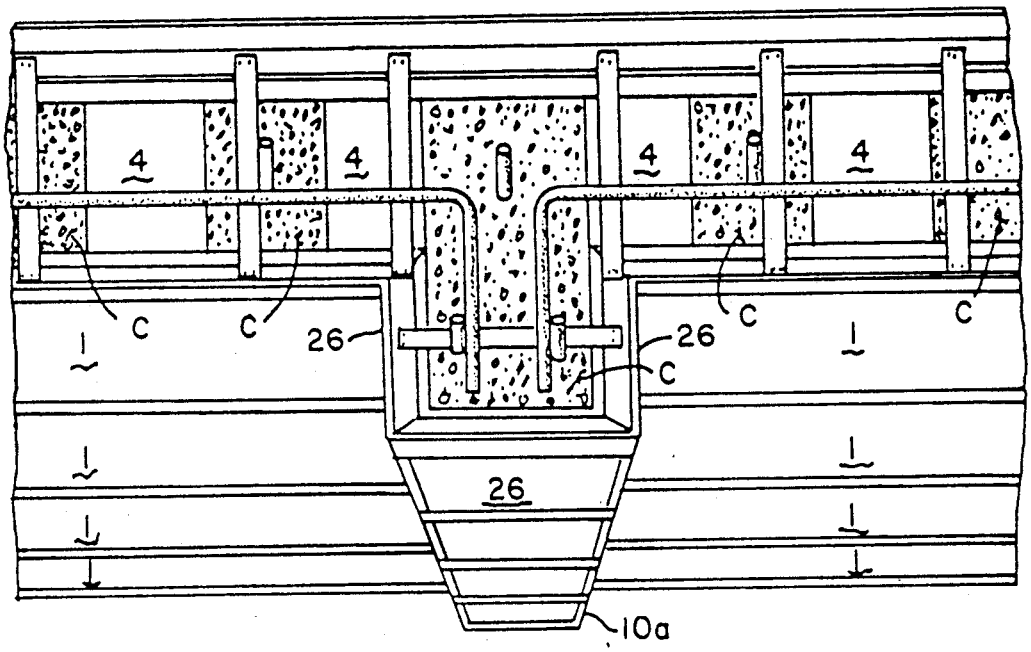
FIG. 8 is an oblique view, from above, showing a formed wall, after concrete is poured therein, and further disclosing how a column may be integrated into the structure of the wall for strength reinforcement.

As can also be noted, a series of tee-shaped ties 10, spaced apart by means of their shown straps 11, are then conveniently interfitted upon the top edge of the lowermost wall forms 1, and in this manner conveniently align and readily accept any upper wall form 1 for its installation, when completing the fabrication of the formed wall, constructed of these polystyrene units, in preparation for the pouring of fresh concrete therein. As can further be seen in FIG. 1, such tee-shaped ties 10 are also separated by means of the said series of straps 11, and may be interfitted upon the top or upper edge of the uppermost wall form, in preparation for the arrangement and pouring of a top beam plate cap thereon, in the manner as will be subsequently described. In addition, L-shaped inside corner bracing, as at 10*a*, may be provided in the corners, as shown in FIG. 1, or likewise may be provided at outside corners, as shown in FIG. 8, to add a lattice work of bracing throughout the structured wall to complement the erection of the wall forms into their assembled structure in preparation for a pouring of concrete. In any event, as can be seen, once the wall forms 1 are conveniently installed, upon their selectively implaced L-shaped or tee-shaped ties, as can be noted, the formed wall of these polystyrene units is ready for location of the various rebars, such as the latticework of reinforcement rods 12, as can be seen. These rods may extend both vertically and horizontally within the wall structure, preferably within the voids between the various blocks or spacer means 4, in preparation for pouring of concrete therein. As can also be noted, the lowermost reinforcing rods 12 may be tied into the assembly of rebars 7, extending from the footings, and it is also likely, as at the intended corner of a building, the rebars may be turned, as noted at 13, and tied into a vertical or other horizontally disposed reinforcement rods thereat, to provide adequate structural strength, for the building, at the corner structure.

As can also be seen, thermobreaks, as at 13*a*, are located at particular locations between the inner and outer walls of the structure, as shown in FIG. 1, in order to provide means for preventing the transfer of temperature, whether it be cold or warm, from the outside wall, to the inside wall, once a building has been assembled, to further add to its insulative value and efficiency.

As can be noted at FIG. 1, once the wall assembly is fabricated, and as further shown in 3, the interior of the fabricated wall forms contain a variety of vertically and horizontally disposed latticework voids, concrete C is poured therein, and flows, during the completion of monolithic wall structure, being fabricated of the combination of polymer, and concrete, in the as shown and described herein.

As can be seen in FIG. 2, the corner the wall structure, as shown in FIG. 1, is generally , and the upper tee-shaped ties 10 with their spacing 11 are generally disclosed. In addition, at least the blocks or spacer means 4 are adequately disclosed, between latticework of poured concrete, as at C. The grid work of rebars 12 are likewise disposed, having been previously positioned before the pouring of any of the shown concrete therein.

In the assembly of the wall forms of the invention, and particularly at predetermined positions along the length of the forms, bracing, as at 13, is required, in order to position and hold the wall forms into their erected location, and to further reinforce against any bulging of the forms during pouring and curing of the concrete therein. Each these bracings 13 are generally a length of two by four, or wood bracing of other dimension, and to a height equivalent to the height of the intended wall. These bracing are into position by means of the pre-extension of tie 14 through the wall forms, and likewise through aligned apertures provided within the bracings 13, and then held into position by means of removable fasteners, as at 15, which, as previous summarized, once the wall is erected, the concrete poured, and cured, the fasteners may simply be removed, the bracing 13 removed, and the extending ends of emplaced tie means 14 may simply be bent free and broken from the constructed wall. Preferably this will be performed without causing too much damage to the surface of the polystyrene sheets within the vicinity of their proximate surface.

Figure 5A:
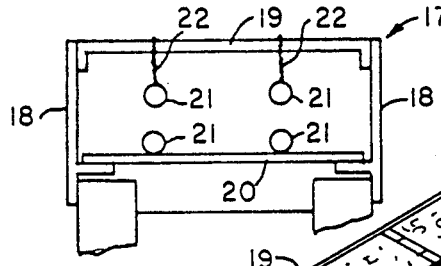
FIG. 5A provides an end view of the upper top beam cap plate that is formed along the upper edge of any wall formed in accordance with the teachings of this invention.
Figure 5:
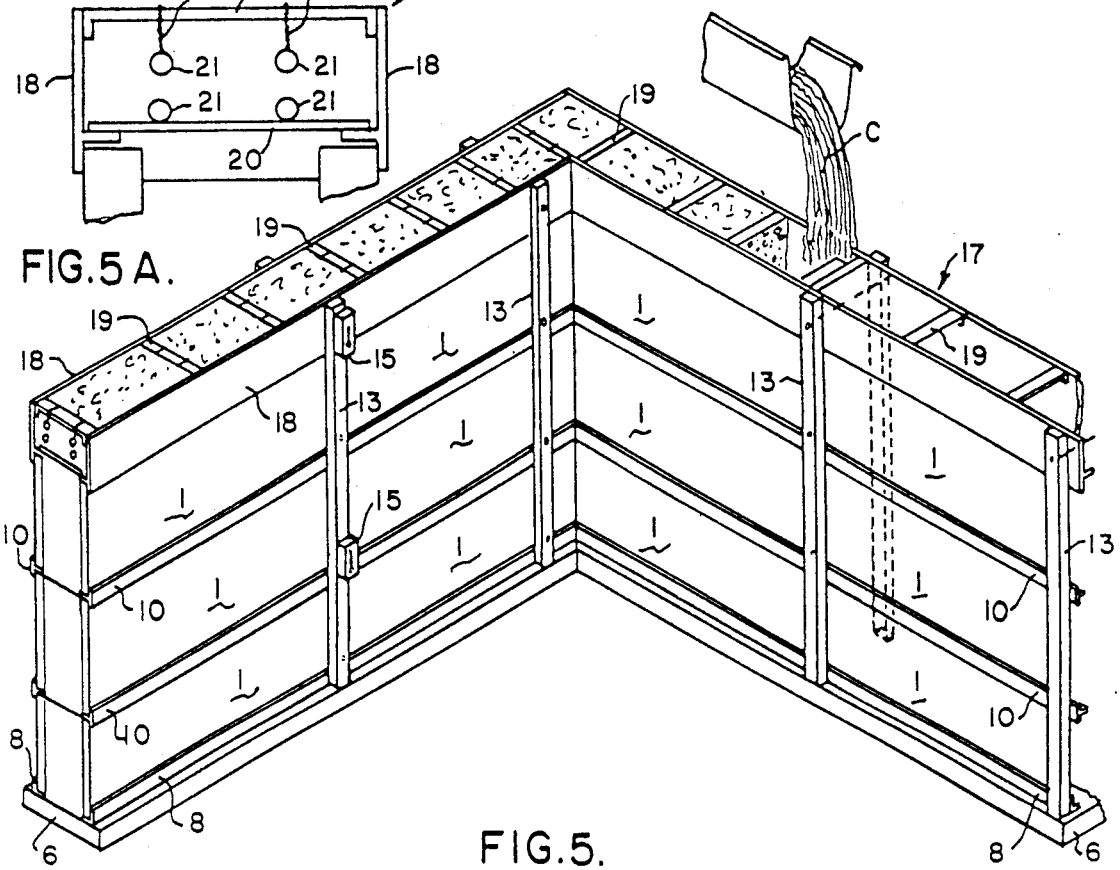
FIG. 5 shows an isometric view of a wall form at a corner in the process of having concrete poured therein.
Figure 7:
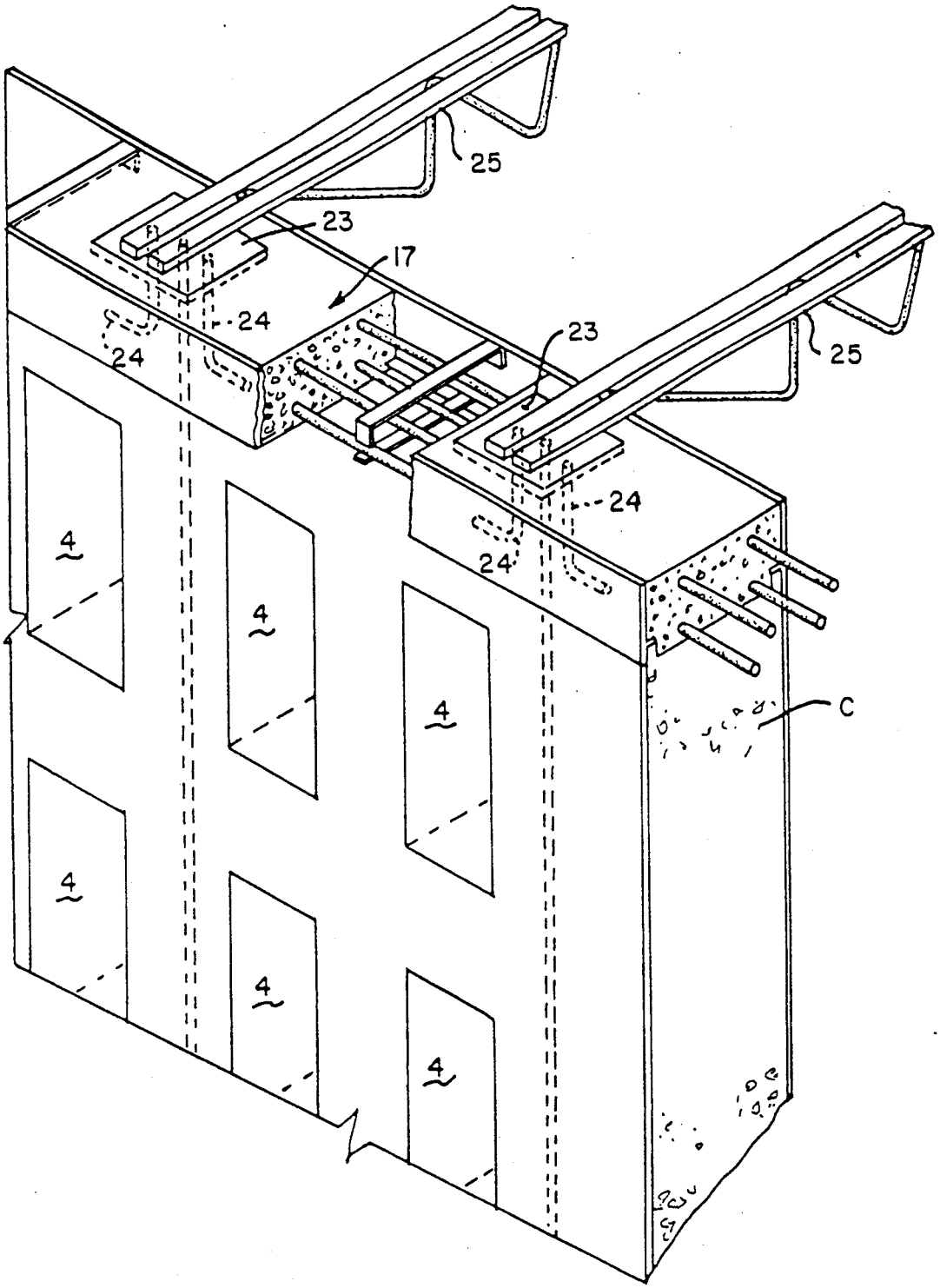
FIG. 7 discloses an isometric view of the upper edge of the composite wall of this invention, having its top beam plate cap arranged thereon, and incorporating header plates for supporting roof girders, as shown.

The FIG. 5 shows the erected wall forms, and in this particular instance being approximately three of them vertically stacked one upon the other, resting upon their footing 6, and the disposed L-shaped ties 8, and the tee-shaped ties 10 which are horizontally arranged and located intermediate the upper adjacent supported wall forms, as shown. The bracings 13, and their disposed fasteners 15, are likewise disclosed. As can be noted, concrete, as at C, being delivered by a chute is in the process of being poured into the latticework of voids located within the erected wall forms. In addition, as can be seen in FIG. 5, the top beam plate cap 17 has been conveniently formed into position, and essentially replaces any tee-shaped tie at this upper edge location, in order to provide a continuous poured concrete beam, at this location, which is integrally structured with the concrete latticework within the wall forms located there below, in order to afford a structurally reinforced beam, at this location, and upon which roof girders may be positioned. FIG. 5A discloses a cross section of the plate cap, wherein the side plates 18 generally at their lower positions have an equivalent configuration to the tee-shaped ties, but in this particular instance, the side plates extend upwardly, for that height desired for the fabricated top beam, being previously spaced apart by means of the series of tie means 19 and 20, as shown. These tie means are spaced at predetermined locations, between the side plates 18, as can be seen FIG. 5. Reinforcing rods may be positioned upon the lower tie means 20, and additional reinforcement rebars 21 may be tied and suspended, as shown at 22, from the upper tie means 19 of the plate cap. As disclosed in FIG. 7, header plates 23 are positioned at particular locations along the length of the top beam, with these header plates being positioned by means of their stub shaft rebars 24 before the poured concrete sets. And, upon the erection of the building, roof rafters 25 may be positioned at particular dimensions on center with respect to each other, along the length of the building, in order to provide support for any roof to be assembled thereon. This drawing also incorporates the uniqueness of the constructed latticework for the reinforced concrete C, after its curing, with the previously disposed series of positioning blocks or spacer means 4 therein, of the styrene wall forms as conveniently embedded within and integrally forming a part of the composite and monolithic structure.

Figure 6:
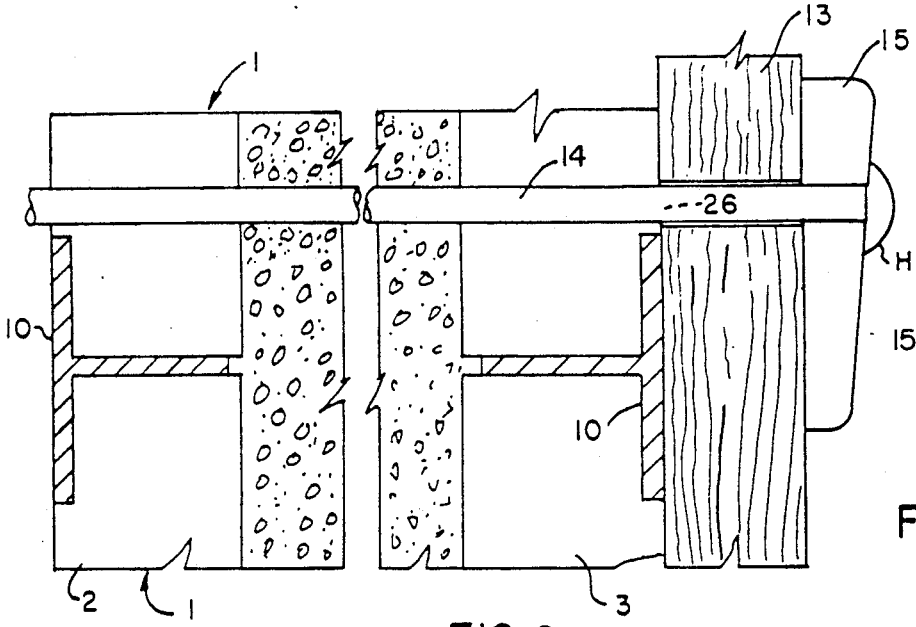
FIG. 6 provides a sectional view through a formed wall, and disclosing a pair of tee-shaped ties, a brace, and the fasteners removably secured to a tie means, used to reinforce the formed wall in preparation for, during, and after pouring of concrete occurs.
Figure 6A:
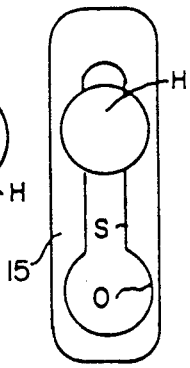
FIG. 6A is an end view of the removable fastener, and its tie means, as shown in FIG. 6.

FIGS. 6 and 6A provide an additional view of the relationship between the wall form units 1, the tree-shaped ties 10, and the tie means 11 that extend through the wall forms, and their associated braces 13 for being tightening and held in position by means of the beveled fasteners 15, disclosed. These fasteners are readily available in the art, generally being called dogs or cats heads, and simply incorporate a beveled surface, having a slot S therethrough, communicating with an enlarged opening O, through which the head H of the tie means 11 inserts, and slides, until it tightly binds against the bracing 13, as can be seen. Once the wall has been formed, the concrete poured, and sets, a hammering of the removable fastener 15, as from its bottom, as shown in FIG. 6, disengages it from its binding against the bracing 13, loosens it from the fastening means head H, for its removal. Then, the fastening means may simply be broken off, as at the location 26, to be flush with the outer surface of the sheet 3, or 2, of the wall forms 1.

Various modifications to the structure of the application of the wall forms of this invention may likewise be made. These modifications, such as shown in FIG. 8, include the shaped locating of smaller forms, as at 26, either interiorly or exteriorly of the disposed units 1, so as to form a pilaster, into which concrete may be poured, being fully reinforced in its erection, as shown by the plurality of rebars extending therein, and in this manner provides an additional support so as to enhance its reinforcement against wind velocity, and even earthquakes, and other abrupt forces exerted upon the building, during its useful life.

Figure 9:
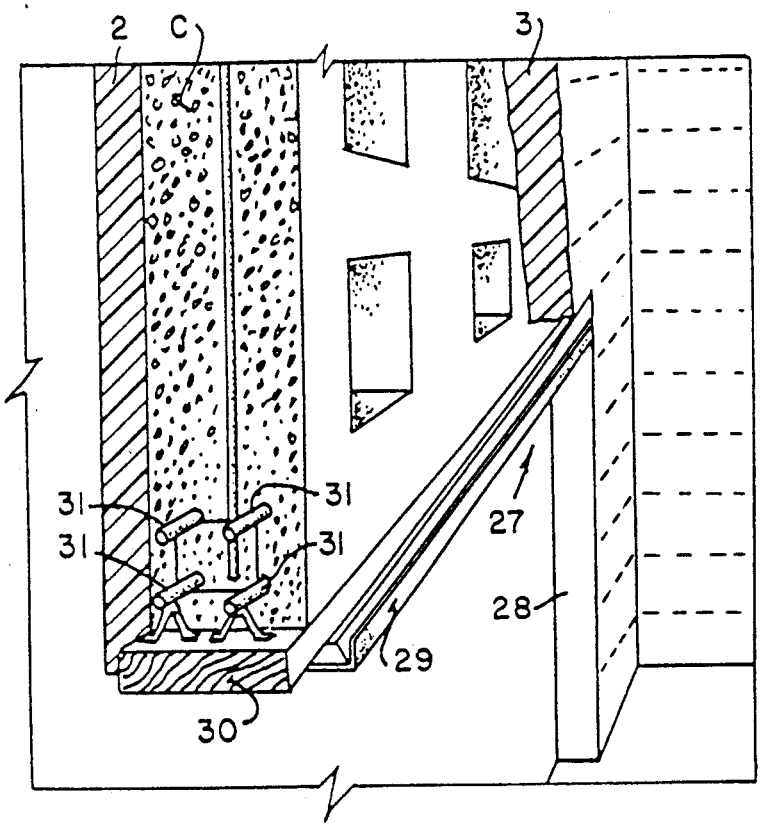
FIG. 9 is an isolated partial view of a formed wall, and showing header and jamb structure for forming a window or door aperture within the constructed wall.

FIG. 9 discloses the relationship of the sheets 2 and 3, of the wall forms, with the poured concrete C therein, and which is conveniently shaped, during the erection of the wall forms, so as to provide an aperture, as at 27 and therein furnish either a window, or door, for access into or out of the completed building. Various jamb forms 28 and header forms 29 in addition to the header board 30 may be shaped into position, once the wall forms are cut to the configuration of the intended and dimensioned door or window access, and then reinforcements, as shown at 31, may be conveniently positioned, in preparation for the pouring of the concrete C, so as to provide a reinforced header structure for the building aperture.

Figure 10:
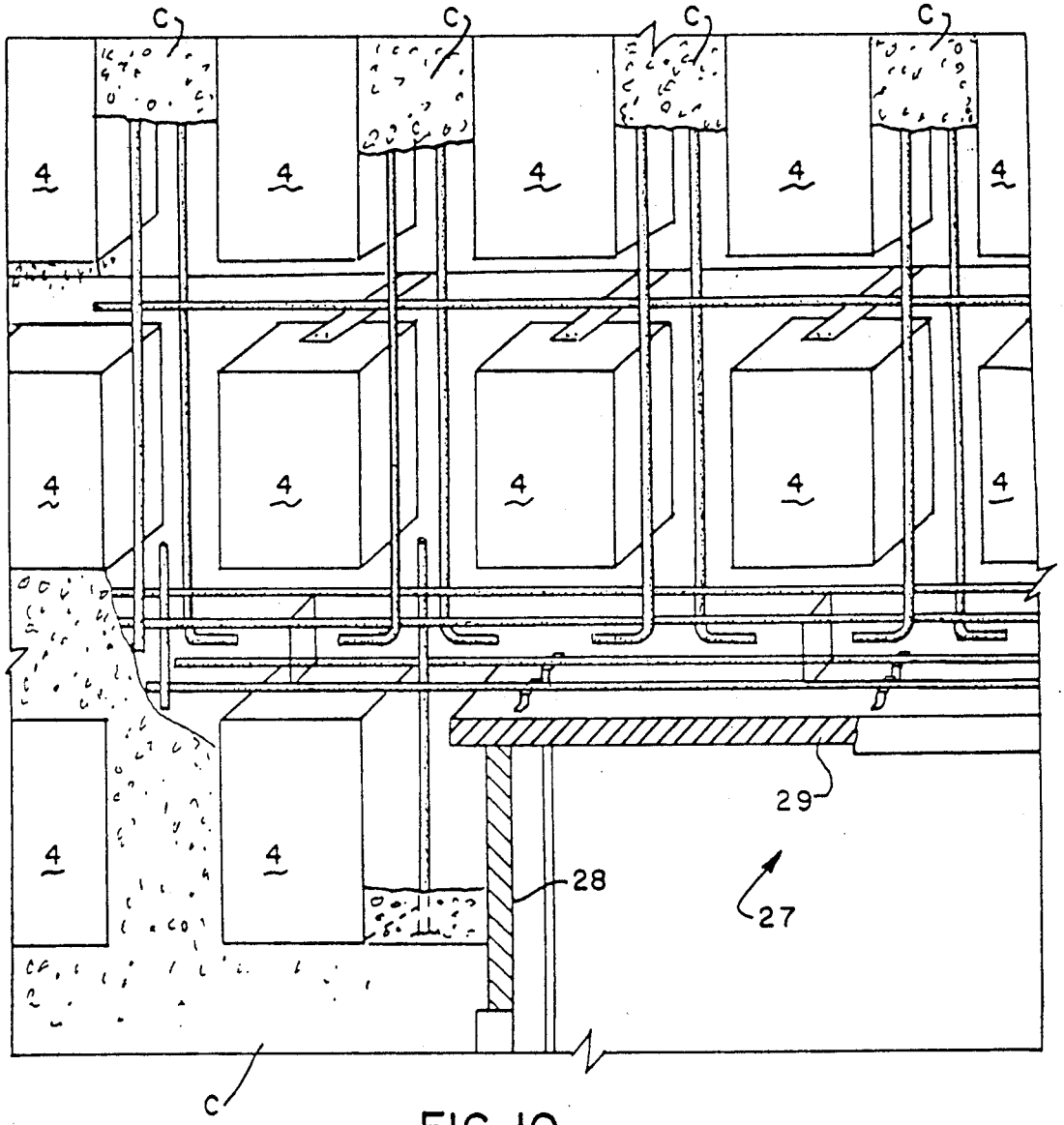
FIG. 10 shows a sectional view wherein the interior sheet of the wall form is removed, showing the emplacement of reinforcing rods therein, concrete partially in place, and the jamb and header portion of a door aperture.

FIG. 10 provides a further view of an assembled wall structure, similar to that as shown in FIG. 9, disclosing the relationship of the wall form blocks or spacer means 4, with the reinforced concrete C latticework provided therethrough, and the jamb 28 and header 29 positioned for accommodating the arrangement of the aperture 27 for the structured building.

In any event, the assembled wall, from its various wall forms 1, its tee and L-shaped ties, supporting them in position, aligned upon a footing, and the constructed top beam is readily disclosed in the variety of drawings as furnished in this disclosure. And, as previously summarized, once the building is structured, incorporating its lattice work of fully reinforced concrete, the wall form units remain in position, having their sheets 2 arranged exteriorly of the formed wall, while the interior sheet 3 is permanently affixed thereto. In addition, and as earlier summarized various applications of interior or exterior facades may be applied to sheets 2 and 3, such as the application of a laminated polymer or plastic to the interior surface of the sheet 3, to provide it with a finished appearance, and which may also be useful for use under low temperature conditions, or dry wall may be connected to the tee-shaped ties, in the manner as known in the art, to provide a finished wall interiorly of the building, and to which paint, wallpaper, or the like, can be applied. Furthermore, the exterior of the building may have a vapor barrier applied thereto, and then a facade of brickwork, or other material, applied there against to provide an exterior for the fabricated building. Or, in the alternative, a latticework or netting or wire may be applied over the exterior surface of the sheet 2, and stucco or other plaster applied thereto, to provide that type of exterior finished surface for the constructed building.

Figure 11:
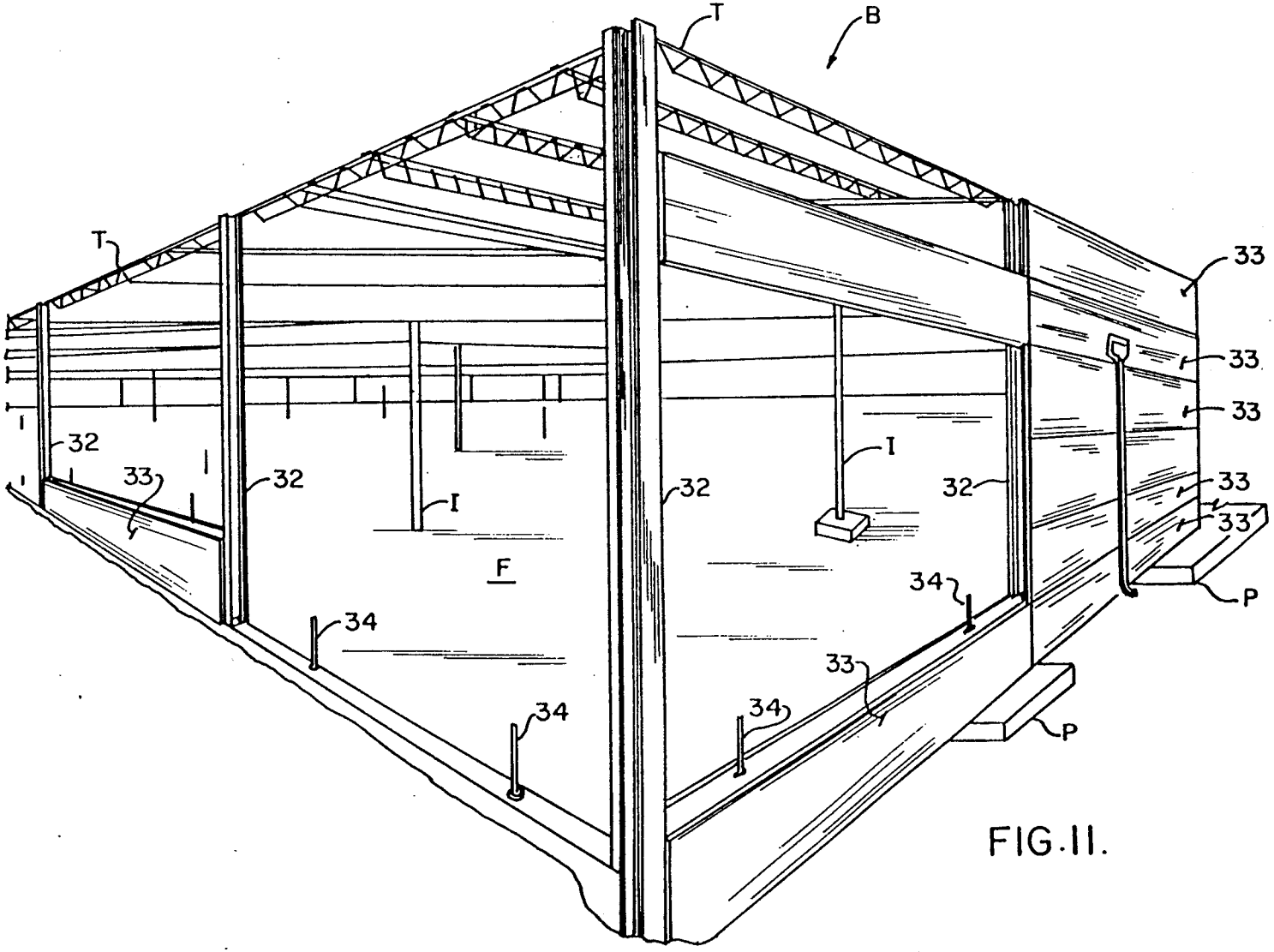
FIG. 11 provides a perspective view of a building under construction, showing the various vertical braces or supports prepositioned in the fabrication of the building structure, and further disclosing a series of the wall form panels of this invention, as previously prepared at the manufacturing plant, after their transfer out to the job site, for insertion between a pair of spaced apart vertical supports for use in the fabrication of the building wall structure.

As can be seen in FIG. 11, a variation upon the subject matter of this invention is disclosed, particularly relating to the prefabrication of wall panel sections, at the manufacturing plant, which are then taken out to the job site for assembly and erection into the building structure. As can be noted, the building B includes a series of vertical supports, or beams, as shown at 32, and these beams are piered within the foundation of the building, by means of concrete, or other means for fastening. The truss section of the roof, as shown at T, are likewise positioned at the upper edges of the shown vertical supports, for eventually forming the roof structure for the building. In this particular instance, each of the vertical supports 32 are fabricated in the configuration of an I-beam, and the prefabricated wall panels, such as shown at 33, are slid into position between the various vertical supports, and interlocked together by means of their aligned fasteners, as noted at 34.

Figure 14:
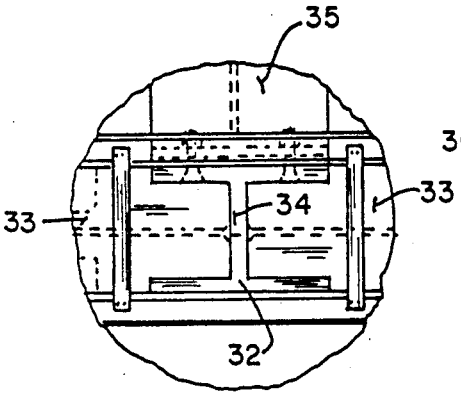
FIG. 14 is a top view of that segment of a building wall looking downwardly upon one of its vertical supports to disclose how the completed wall forms are inserted within the support structure, during assembly of a building wall.

Other standard supporting structure included within the building, obviously, will have been previous located, such as the foundation slab F, in addition to the interior beams I, as noted. As can be seen more specifically in FIG. 14, the vertical support or beam 32 is readily disclosed, and the prefabricated slabs formed of the wall forms 33 of this invention are arranged in alignment leading laterally from the web 34 of the support 32. In addition, various roof trusses, as at 35, will likewise join with the upper edge of the support 32, for use in the formation of the building roof.

A further variation upon the structure of the building assembled in the manner as described in this FIG. 11 can be understood from reviewing the structure disclosed and described therein. For example, to the left side of the disclosed corner, a foundation or footing for the building will have been previously poured, and have the series of fasteners 34 extending upwardly therefrom, and onto which the prefabricated slabs may be attached, when installed. On the other hand, as can be seen to the right side of the corner of the building as disclosed in FIG. 11, no foundation or footing may be provided for the building, but rather, only a series of piers, as shown at P, may have been previously installed. Then, the bottom prefabricated slab of the wall form 33, as noted, can be lowered into position within the various vertical supports or beams 32, slid downwardly, and come to rest upon the implaced piers P. In this manner, the bottom form 33, as noted, becomes a form of footing for the building, that is installed well below ground level, and the frost line, and therein provide the initial support for the base of the wall of the building to be erected. And, the vertical supports 32 will have been previously cemented in place within the piers P, to provide for the initial erection of the building, in preparation for its reception of the various prefabricated slabs of wall forms 33, as noted.

Figure 12:
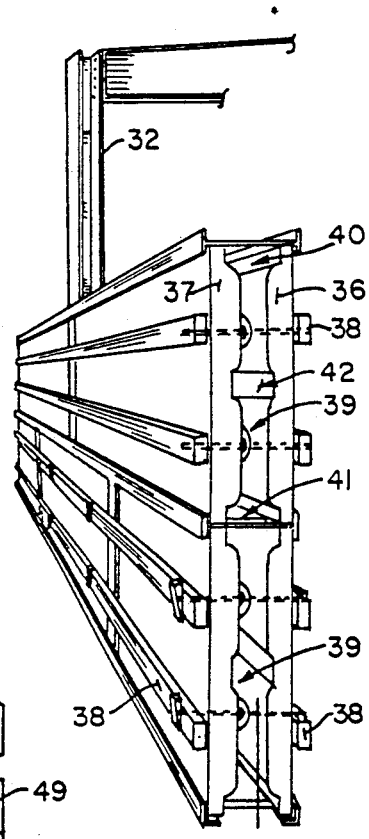
FIG. 12 discloses a perspective end view of one of the walls of a building in the process of assembly, but in this particular instance, the wall forms are assembled at the building site in preparation for pouring of concrete therein.
Figure 15:
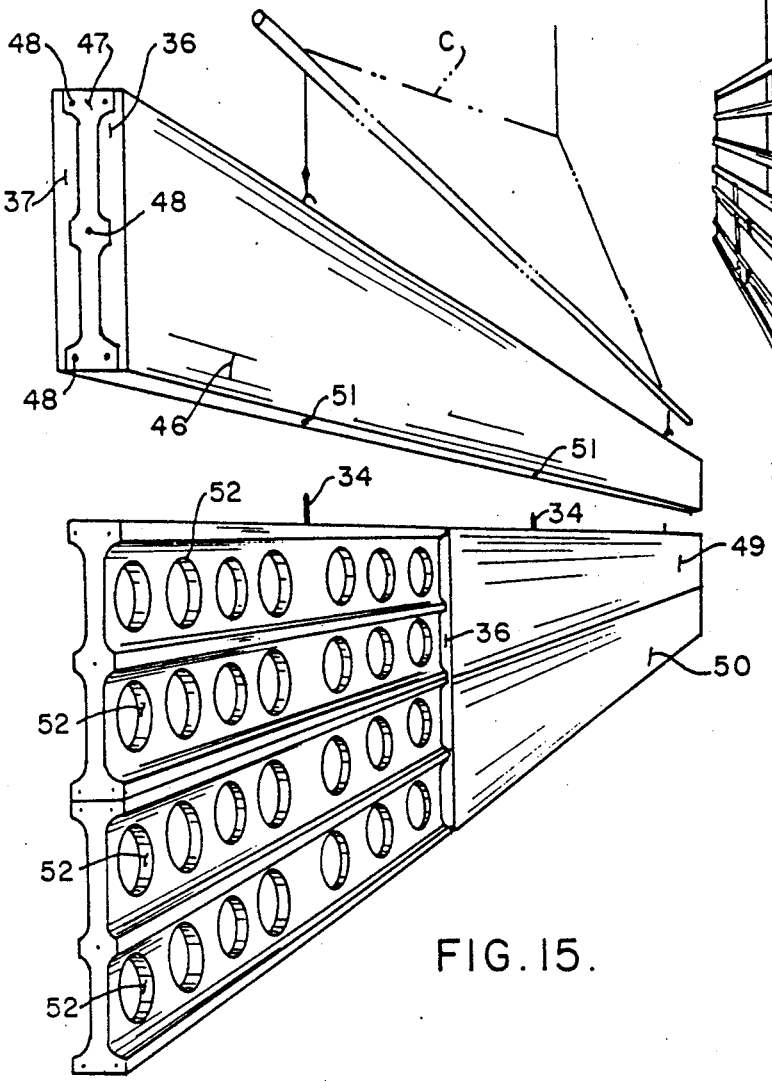
FIG. 15 discloses how the prefabricated wall form structures, in their alternative embodiment, where the walls are poured with concrete at the manufacturing plant, and eventually transported to the building job site, where the wall forms are erected into a building wall structure; and further disclosing a part of the two lower wall forms removed for showing the configuration of the poured concrete therein, and where spacer spools are arranged to create voids within the web of the shaped concrete I-beam structure during wall form construction.

The structure of the wall forms 33 as previously referred to may be of one of two types, either of the type of wall form, as previously described in this application, wherein the wall forms are assembled and taken out to the job site for the pouring of the concrete therein, during assembly of the building. This particular configuration for the wall forms of this invention as shown in FIG. 12. In the alternative, the modified form of wall forms, which are prefabricated at the manufacturing plant, and as shown in FIG. 15, may be manufactured at the manufacturing plant, and taken out to the job site, for assembly between the vertical supporting beams 32, in the manner as previously explained.

With respect to the configuration of the wall forms as shown in FIG. 12, these wall forms may be assembled in the manner as earlier described in this application, formed of a series of inner and outer sheets 36 and 37, secured into position by means of the series of bracings, as at 38, with the inner and outer sheets 36 and 37, which are similar to the polymer material formed sheets previously described at 2 and 3, within this application. On the other hand, as can be noted at FIG. 12, the interior of the sheets 36 and 37 are preshaped, during their formation, to provide the configuration of an I-shaped beam, at least in cross-section, as noted at 39, so that once any concrete or other cementitious material is poured therein, and formed, its cross-sectional configuration will be in the shape of an I-beam, having upper and lower flanges, as at 40 and 41, and even a midpoint flange, as at 42, to provide for reinforcement, at these segments. The wall panels once assembled into the configuration and readied for pouring will have the bracings 38 affixed in position, to fold the forms in place, so that concrete may be poured within its void interior, in the manner as previously described, to form the reinforced polymer formed building structure shaped into the configuration of a wall for the final building configuration.

Figure 13:
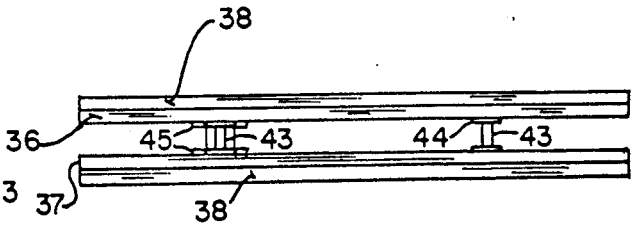
FIG. 13 provides a top view of a building wall form, such as one shown in FIG. 12, disclosing the inner and outer sheets forming the wall form, and a pair of the spacer spools disposed therein before any concrete is poured within the formed form structure.

As further noted in FIG. 13, the spacers 43 are arranged intermediate the inner and outer wall forms 36 and 37. The bracing 38 holding the wall forms into position, when fabricated into the form structure in preparation for pouring the concrete, can likewise be seen. The spools 43, as noted, may be formed themselves from polymers, and includes a central core, as noted, with a pair of side flanges. It is these side flanges, as at 44 and 45, that may be either adhesively connected to the inner surface of the liners 36 and 37, or held into position by means of tie wires, as previously explained, or may be secured by means of double face pressure sensitive adhesive, to secure the inner and outer liners 36 and 37 into position, during the fabrication of the wall form structure. The spool shaped members 43 may be fabricated of polymer itself, such as polystyrene, or perhaps even of wood. Nevertheless, they are reasonably light of weight, and add to the dexterity of handling of the wall forms, once assembled, at the manufacturing site, where concrete can be either poured therein to prefabricate the wall panels, as shown in FIG. 15, or taken out to the job site in preparation for pouring of concrete therein, as disclosed in FIG. 12.

Also, the wall forms may include significantly sized spaces, so that only a latticework of surface concrete is joined to form verticle supports and upper and lower beams or headers, with the remainder of the space between the liners being taken up with polymer blocks, in the manner as previously described.

As can be seen in FIG. 15, each wall panel 46, particularly where they are prefabricated at the plant site, includes the shaped inner and outer liners 36 and 37, and in this particular instance, the reinforced concrete, as at 47, will have been prepoured therein, with adequate reinforcement, as at 48, strategically located, and aligned, for reinforcement purposes. As noted, the upper panel 46 is being located into position by means of a crane (not shown), through its cable arrangement, as at C. The previously installed panels, as at 49 and 50, will have been located in position, preferably between the vertical supports 32, in the manner as previously described. Each panel is likewise fabricated with an upstanding alignment fastener, as previously explained at 34, and which inserts within a mating aperture, as at 51, to provide for convenient and proper alignment of the wall panels, once assembled into the building structure. While the supports 32 are not shown in FIG. 15, these panels, as disclosed, will be arranged between such supports, as shown at 32, in both FIGS. 11 and 12.

Also disclosed in FIG. 15, a portion of the inner and outer liners 36 and 37 are removed, from the lower left portion of this figure, in order to disclose the I-beam configuration of the concrete formed within each panel section. In addition, the apertures as shown at 52 are formed within each of the concrete I-beam structures by means of the spools 43, as previously explained.

Obviously, this invention can be used in fabricating all types of building structures, whether it be of the commercial, industrial or residential type.

Variations or modifications to the structure of this invention, its application, and method of usage, may occur to those skilled in the art upon reviewing the subject matter of this invention. Such variations or modifications, if within the spirit of this invention, are intended to be encompassed within the scope of any claims to patent protection issuing upon this development. The description of the preferred embodiment set forth herein, is done so for illustrative purposes only.

Having thus described the invention, what is claimed and desired to be secured by Letters Patent is:

1. In a polymer building or other structured wall form wherein forms prefabricated of polymer and the like are constructed and assembled as wall forms, and braced into position for reception of concrete therein for creation of such a composite wall, the improvement which comprises, each wall form fabricated of an extensibly sized pair of sheets of polymer and spaced apart in the constructed wall a predetermined distance for forming a location for pouring of a quantity of concrete therein, each sheet of the pair having an inner surface, each inner surface being shaped to provide one-half of the configuration of an I-beam structure for any concrete poured therein, a series of spacer means disposed between each of the arranged sheets, and with said spacer means being connected for extending from the inner face of said sheets to provide a spacing therebetween for pouring of said concrete, said spacer means being located at predetermined distances from each other so as to provide in the wall form construction a latticework of communicating voids into which concrete may be deposited therearound to form a monolithic wall constructed of concrete and the polymer wall forms, the constructed wall incorporating therein a latticework of formed concrete for reinforcement of said formed wall and providing it with a degree of strength to function as a building wall, and for supporting of a roof or other structure thereon, said combination of the concrete latticework and the arranged polymer sheets and spacer means being integrally constructed into the formed wall for enhancement of its insulation, each spacer means comprising a spool-shaped means, said spool-shaped spacer means being formed of polymer, said arranged sheets and spacer means providing the wall forms having a series of reinforcing rods arranged therein for increasing the structural strength of any formed composite wall, said concrete I-beam structure having upper and lower flanges, and said reinforcing rods being located within said flanges, and there being a plurality of said wall forms forming each fabricated wall.

2. The invention of claim 1 and wherein said polymer comprising polystyrene.

3. The invention of claim 1 and wherein said formed polymer sheets and spool means being fabricated of polystyrene.

4. The invention of claim 1 and wherein said formed polymer sheets and spacer means being prefabricated of urethane foam.

5. The invention of claim 1 and wherein said wall forms and reinforced concrete arranged therein being fabricated at the manufacturing plant.

6. The invention of claim 1 and wherein said plurality of wall forms and each fabricated wall being assembled at the building site, and concrete being poured therein in the formation of the building wall.

7. The invention of claim 1 and wherein each adjacent set of vertically stacked wall forms having an approximately arranged supporting tie therebetween to assure their alignment and the connection of said contiguous wall forms together during assembly.

8. The invention of claim 7 and wherein said wall forms at their bottom edges arranged upon a footing, and their being a supporting tie resting upon the footing and positioning and locating each sheet of an arranged wall form upon the same.

9. The invention of claim 1 and including a series of vertical supports provided spacely along the building structure, and said wall forms cooperating with each vertical support to provide for their alignment and securement into the building structure in the formation of the building wall.

10. The invention of claim 1 and wherein each spool-shaped spacer means having an inner core, a pair of flanges connecting to each end of the core, and said flanges being secured to the shaped inner surfaces of the inner and outer walls forming a wall form.

11. The invention of claim 10 and wherein adhesive means securing the outer surface of each spool flange to the inner surface of each liner of a wall form.

12. The invention of claim 1 and including thermobreaks provided within the wall structure to function as an insulation against the transmission of temperatures from exteriorly to interiorly of the building structured wall.

13. The invention of claim 7 and including a series of piers for the building structure, the lowermost stacked wall form resting upon said piers and functioning as a base footing for the assembled building.

14. In a polymer building or other structured wall form wherein forms prefabricated of polymer and the like are constructed and assembled as wall forms, and braced into position for reception of concrete therein for creation of such a composite wall, the improvement which comprises, each wall form fabricated of an extensibly sized pair of sheets of polymer and spaced apart in the constructed wall a predetermined distance for forming a location for pouring of a quantity of concrete therein, each sheet of the pair having an inner surface, each inner surface being shaped to provide one-half of the configuration of an I-beam structure for any concrete poured therein, a series of spacer means disposed between each of the arranged sheets, and with said spacer means being connected for extending from the inner face of said sheets to provide a spacing therebetween for pouring of said concrete, said spacer means being located at predetermined distances from each other so as to provide in the wall form construction a latticework of communicating voids into which concrete may be deposited therearound to form a monolithic wall constructed of concrete and the polymer wall forms, the constructed wall incorporating therein a latticework of formed concrete for reinforcement of said formed wall and providing it with a degree of strength to function as a building wall, and for supporting of a roof or other structure thereon, said combination of the concrete latticework and the arranged polymer sheets and spacer means being integrally constructed into the formed wall for enhancement of its insulation, each spacer means comprising a spool-shaped means, and each spacer means formed of a spool having an inner core, a pair of flanges connecting to each end of the core, and said flanges being secured to the shaped inner surfaces of the inner and outer walls forming a wall form, adhesive means securing the outer surface of each spool flange to the inner surface of each liner of a wall form, said adhesive means comprising a double faced pressure sensitive adhesive applied to the outer surface of each flange of a spool means and arranged for connecting to the inner surface of each inner and outer liner of a wall form.

* * * * *